US006745431B2

(12) United States Patent
Dijksman et al.

(10) Patent No.: US 6,745,431 B2
(45) Date of Patent: Jun. 8, 2004

(54) ROBOT FOR VACUUM CLEANING SURFACES VIA A CYCLOID MOVEMENT

(75) Inventors: Johan Frederik Dijksman, Eindhoven (NL); Marinus Josephus Jakobus Dona, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 229 days.

(21) Appl. No.: 10/055,422

(22) Filed: Jan. 22, 2002

(65) Prior Publication Data

US 2002/0112899 A1 Aug. 22, 2002

(30) Foreign Application Priority Data

Jan. 25, 2001 (EP) ..... 01200300

(51) Int. Cl.[7] ..... A47L 9/28

(52) U.S. Cl. ..... 15/319; 15/340.1; 701/24; 701/301

(58) Field of Search ..... 15/319, 340.1; 701/23, 24, 25, 26, 27, 300, 301

(56) References Cited

U.S. PATENT DOCUMENTS 4,306,329 A * 12/1981 Yokoi ..... 15/319
5,815,880 A * 10/1998 Nakanishi ..... 15/319
6,553,612 B1 * 4/2003 Dyson et al. ..... 15/340.1

* cited by examiner

*Primary Examiner*—Theresa T. Snider

(57) ABSTRACT

The invention relates to a robot vacuum cleaner for cleaning surfaces (9), which robot vacuum cleaner is provided with a housing (1), a suction unit (3) accommodated in the housing, a suction nozzle (7) mounted to the housing so as to be present near the surface in operation, a motor-drivable wheel system (13) by which the housing can be displaced over the surface, and an electrical control unit (17) for controlling a displacement of the housing generated by the wheel system. According to the invention, the displacement of the housing controlled by the control unit (17) includes a substantially cycloid movement brought about by a rolling movement of an imaginary rolling circle (37) along an imaginary line of displacement (39) of the housing over the surface, the imaginary rolling circle extending parallel to the surface (9) and being fixed with respect to the housing (1), and the suction nozzle (7) being eccentrically arranged with respect to the rolling circle. As a result, the width of the track cleaned by the suction nozzle during the displacement of the robot along the line of displacement is considerably larger than the main dimension ($W_S$) of the suction nozzle.

5 Claims, 3 Drawing Sheets

ROBOT FOR VACUUM CLEANING SURFACES VIA A CYCLOID MOVEMENT

Figure 1:
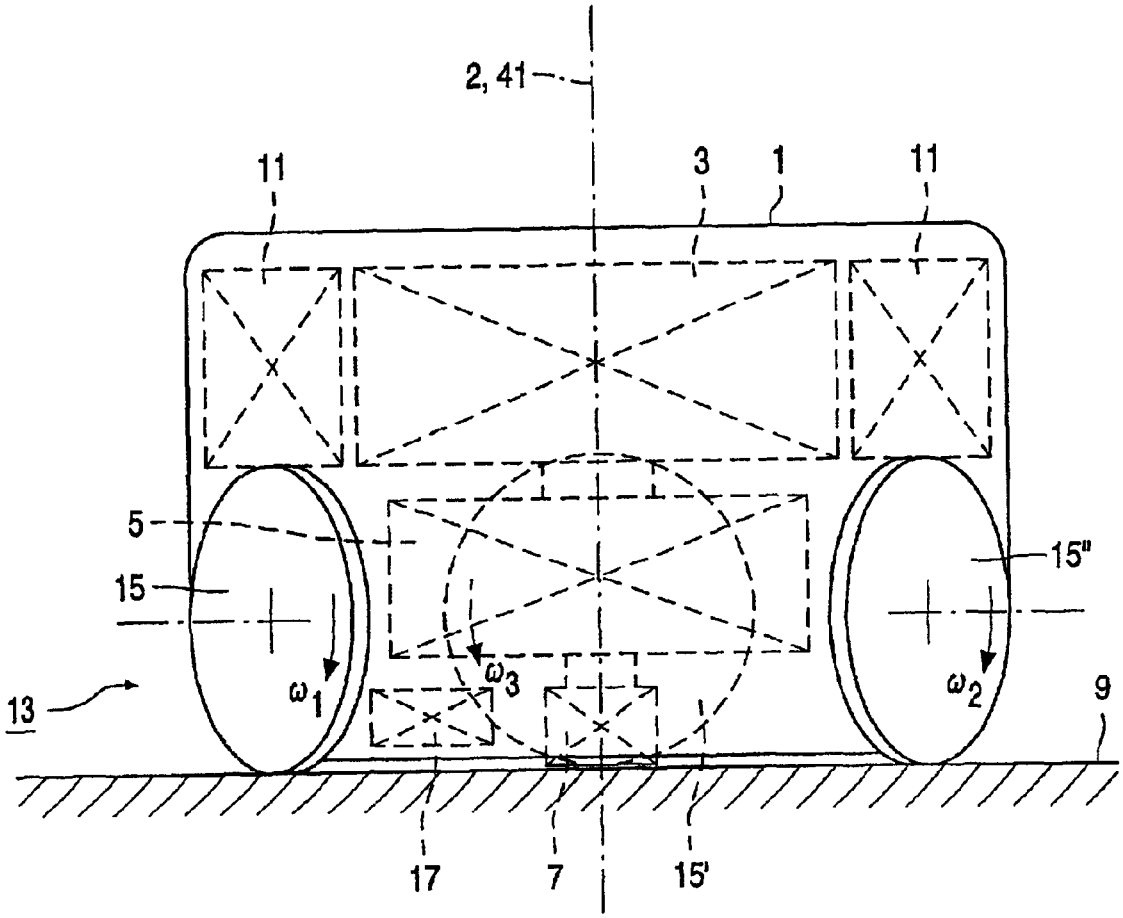

The invention relates to a robot for vacuum cleaning surfaces, which robot is provided with a housing, a suction unit accommodated in said housing, a suction nozzle mounted to the housing, which suction nozzle is situated, during operation, close to a surface to be vacuum cleaned, a motor-drivable wheel system by means of which the housing can be displaced over the surface to be cleaned, and an electrical control member for controlling a displacement of the housing to be generated by means of the wheel system.

Robots of the type mentioned in the opening paragraph are generally known. The control member of such robots controls the wheel system in such a manner that the robot automatically carries out predetermined displacements, or random displacements, over the surface to be cleaned, so that after some time the robot has reached and treated all parts of the surface. Such robots are generally provided with sensors that co-operate with the control member, so that obstacles are avoided as much as possible during displacements of the robot over the surface. Such robots are preferably provided with a battery or accumulator to feed the suction unit, the control member and the drive unit for the wheel system, so that an electrical cord connection is not necessary for this robot. Such a cord connection could hamper or limit the freedom of displacement of the robot.

Batteries and accumulators which can suitably be used in such robots generally have a sufficiently large energy capacity but only a limited power. As a result, the suction unit of such robots has only a limited suction power. In order to make sure that, in spite of the limited suction power, a sufficiently large suction force of the suction nozzle is obtained, i.e. a sufficient underpressure in the suction nozzle, the suction nozzle of such robots generally has limited dimensions. Consequently, a drawback of such robots is that the suction range, i.e. the width of a path treated by the robot during a displacement of the robot along a line of displacement, is limited so that the robot must carry out a comparatively large number of displacements to treat the whole surface to be cleaned. As a result, such robots need a comparatively large amount of time to treat the entire surface area. This drawback is even more manifest in robots of the type mentioned in the opening paragraph which carry out random displacements over the surface, for which the number of necessary displacements will generally substantially exceed the number of necessary displacements of robots carrying out predetermined displacements.

It is an object of the invention to provide a robot of the type mentioned in the opening paragraph, which robot also has a suction nozzle of limited dimensions, but the suction range of which, as defined hereinabove, is increased substantially.

To achieve this object, a robot in accordance with the invention is characterized in that the displacement controlled by the control member comprises a substantially cycloid movement that is brought about by a rolling motion of an imaginary rolling circle along an imaginary line of displacement of the housing over the surface to be cleaned, the suction nozzle being eccentrically arranged with respect to the rolling circle, which rolling circle extends parallel to the surface to be cleaned and is fixed with respect to the housing. Said cycloid movement not only causes the housing to be moved over the surface in accordance with said line of displacement, but also to be simultaneously rotated about an axis of rotation extending perpendicularly to the surface and through the center of the rolling circle. As the suction nozzle is eccentrically arranged with respect to the rolling circle, the suction nozzle does not move rectilinearly in accordance with the line of displacement, but follows a cycloid that is situated on either side of the line of displacement. By virtue thereof, viewed perpendicularly to the line of displacement, the suction nozzle covers a comparatively wide path of the surface to be cleaned during the displacement of the housing along the line of displacement, so that the suction range, i.e. the width of the path treated by the robot during the displacement of the robot along the line of displacement, is comparatively large.

A particular embodiment of a robot in accordance with the invention is characterized in that the wheel system comprises at least three wheels arranged at regular intervals in accordance with an imaginary base circle, each wheel having a wheel axle extending in accordance with a radial of the base circle and being drivable by means of a separate motor, and each wheel being provided, along its circumference, with a number of rolls each having a roll axle extending in a tangential direction with respect to the wheel axle of the relevant wheel. By means of a suitable, comparatively simple control of the individual motors of the wheels of said wheel system, the housing is displaceable over the surface to be cleaned, in this particular embodiment, in any direction in accordance with a straight or curved line of displacement, rotatable about an axis of rotation extending perpendicularly to the surface, or simultaneously displaceable in accordance with such a line of displacement and rotatable about such an axis of rotation. In this manner, the robot has substantial freedom of movement, and the wheel system can particularly suitably be used to generate the desired cycloid movement of the housing. As each wheel is provided, along its circumference, with said rolls, the individual wheels cannot only be displaced in a customary direction perpendicular to the wheel axles, but also in a direction parallel to the wheel axles. By virtue thereof, a desired displacement of the housing, which can be generated by a suitable rotation of one or more of the wheels about their wheel axles, is not hampered or prevented by insufficient freedom of movement of the other wheels.

A further embodiment of a robot in accordance with the invention is characterized in that the rolling circle is concentric with the base circle, while the radius of the rolling circle is at the most equal to approximately $W_S/2\pi$, where $W_S$ is a main dimension of the suction nozzle, measured along a radial of the base circle. As the radius of the rolling circle is at most equal to approximately $W_S/2\pi$, during one complete revolution of the housing about the axis of rotation, the housing is displaced along the line of displacement over a distance which is at most equal to $W_S$. As the suction nozzle thus is displaced, during one complete revolution of the housing, along the line of displacement over a distance that is at most equal to the main dimension of the suction nozzle, measured along the radial of the base circle, the parts of the path, that is treated by the suction nozzle during a number of successive revolutions of the housing, blend substantially without interspace, viewed in the direction of the line of displacement, so that the robot does not leave parts of the path untreated as a result of the rotating movement.

Yet another embodiment of a robot in accordance with the invention is characterized in that the suction nozzle extends, viewed along said radial of the base circle, substantially up to said base circle. In this further embodiment, the path treated by the suction nozzle during the displacement of the housing in accordance with the line of displacement, has a width that substantially corresponds to the diameter of the base circle. If the wheels are arranged near the circumference of the housing, the width of the path thus corresponds substantially with a principal dimension of the housing, so that the width of the path treated by said robot is clearly visualized to the user of the robot.

A particular embodiment of a robot in accordance with the invention is characterized in that the radius of the rolling circle is smaller than approximately 0.16. $R_B$, where $R_B$ is the radius of the base circle. In this particular embodiment, the principal dimension of the suction nozzle, measured along the radial of the base circle, is at most equal to the radius of the base circle. It has been found that such a principal dimension of the suction nozzle in combination with customary batteries or accumulators results in a sufficient suction force of the suction nozzle, i.e. a sufficient underpressure in the suction nozzle is obtained.

Figure 2:
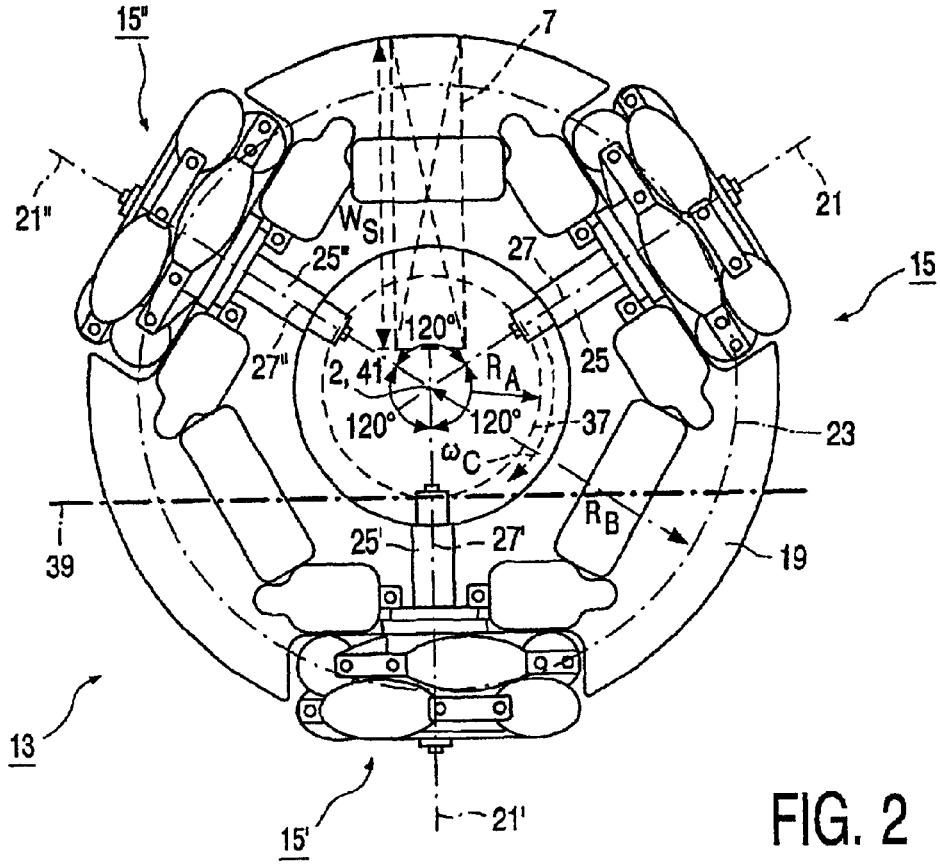
Figure 3:
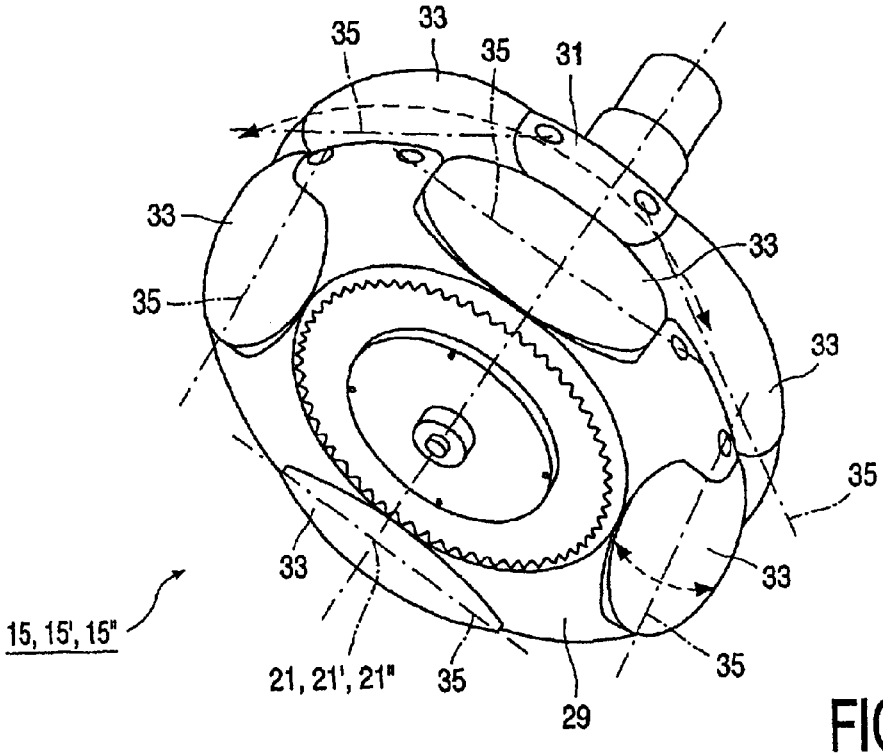
Figure 4:
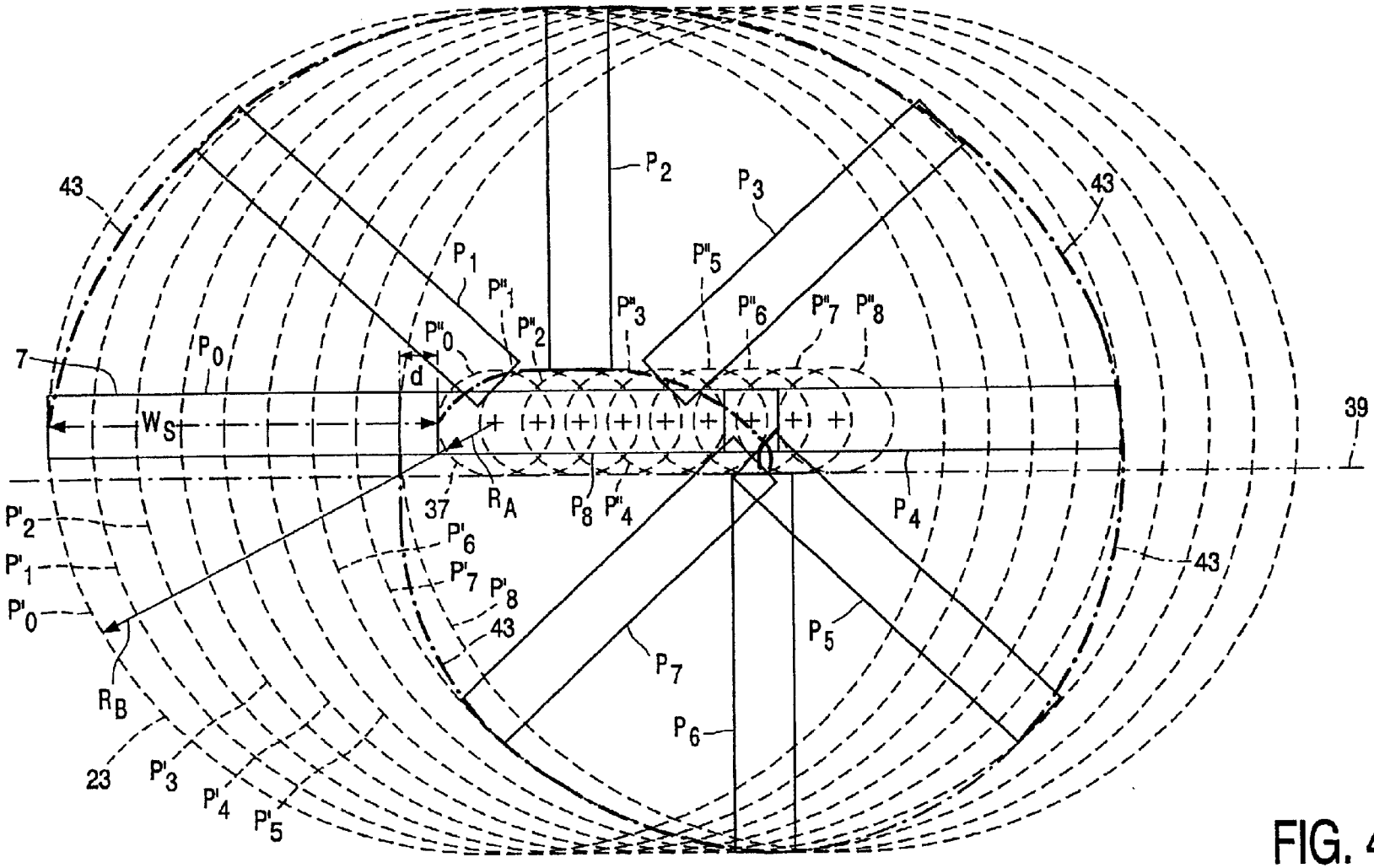

Hereinbelow, embodiments of a robot in accordance with the invention will be described and partly shown in the drawing, wherein FIG. 1 is a diagrammatic side view of a robot in accordance with the invention, FIG. 2 is a plan view of a wheel system of the robot in accordance with FIG. 1, FIG. 3 shows an individual wheel of the wheel system in accordance with FIG. 2, and FIG. 4 diagrammatically shows a cycloid described, in operation, by a suction nozzle of the robot in accordance with FIG. 1 during one complete revolution of the robot.

FIG. 1 diagrammatically shows an embodiment of a robot in accordance with the invention for vacuum cleaning surfaces, which robot comprises a substantially circularly cylindrical synthetic resin housing 1 having a central main axis 2. The housing 1 accommodates an electrical suction unit 3 of a type which is known per se and customarily used in vacuum cleaners. The suction unit 3 is connected to a suction nozzle 7 via a dust compartment 5, which is also arranged in the housing 1, which suction nozzle is provided near a lower side of the housing 1 and, hence, in operation is situated near a surface 9 to be cleaned. The housing 1 further accommodates a number of batteries or accumulators 11 used to feed the suction unit 3 in operation. The robot further comprises a motor-drivable wheel system 13 by means of which the housing 1 including the suction nozzle 7 can be displaced over the surface 9 to be cleaned. In the example shown, the wheel system 13 comprises three wheels 15, 15', 15" which are arranged with respect to each other and composed in a manner which will be described in greater detail hereinafter. The housing 1 further accommodates an electrical control member 17 which is used to control an automatic displacement of the housing 1 over the surface 9, which displacement is to be generated by means of the wheel system 13. In operation, the motor-drivable wheel system 13 and the electrical control member 17 are also fed by said batteries or accumulators 11.

As shown in FIG. 2, the three wheels 15, 15', 15" of the wheel system 13 are rotatably journaled on a disc-shaped metal support 19 of the robot, on which also the housing 1 is secured. The wheels 15, 15', 15" have wheel axles 21, 21', 21" which extend in a common plane parallel to the surface 9 to be cleaned, which wheel axles intersect substantially in the central main axis 2 of the housing 1 and include angles of substantially 120° with each other. The wheels 15, 15', 15" are each situated at a distance $R_B$ from the main axis 2, so that the wheels 15, 15', 15" are arranged at regular intervals in accordance with an imaginary base circle 23 of radius $R_B$ extending parallel to the surface 9 and being fixed with respect to the housing 1, the wheel axles 21, 21', 21" each extending in accordance with a radial of the base circle 23. As is further shown in FIG. 2, the wheel system 13 comprises an individual electric motor 25, 25', 25" for each wheel 15, 15', 15", respectively, the motors 25, 25', 25" comprising, in the example shown, motor axles 27, 27', 27" arranged coaxially with respect to the wheel axles 21, 21', 21", and a transmission, not shown in FIG. 2 for the sake of simplicity, being present between each motor 25, 25', 25" and the relevant wheel 15, 15', 15". As shown in FIG. 3, the wheels 15, 15', 15" each comprise, in the example shown, two basic discs 29, 31 extending perpendicularly to, and being arranged in fixed positions with respect to, the wheel axle 21, 21', 21 ". Along the circumference of each basic disc 29, 31, four rolls 33 are provided at regular intervals, each roll being journaled so as to be rotatable, with respect to the relevant basic disc 29, 31, about a roll axle 35 which extends in a tangential direction with respect to the wheel axle 21, 21', 21 ". It is to be noted that FIG. 3 shows only two rolls 33 of the basic disc 31. The rolls 33 of the basic disc 31 are arranged, viewed in the circumferential direction of the wheel 15, 15', 15", between the rolls 33 of the basic disc 29. In this manner it is achieved that, in operation, in each position of the wheels 15, 15', 15 " the wheels rest with at least one of the rolls 33 on the surface 9.

In operation, the control member 17 controls the motors 25, 25', 25" of the wheel system 13 in such a manner that the robot is automatically displaced over the surface 9 to be cleaned in accordance with an imaginary line of displacement. The robot is provided with sensors that co-operate with the control member 17, which sensors are not shown in the Figures for the sake of simplicity, and are of a type which is known per se and customarily used, by means of which sensors the direction of the line of displacement is automatically changed by the control member 17 if the robot meets obstacles, such as furniture or a wall, on the line of displacement. In the example shown, the control member 17 controls the wheel system 13 in such a manner that the wheel system 13 generates displacements of the housing 1 in accordance with successive, random lines of displacement. As the lines of displacement are random, the robot will reach all parts of the surface 9 after a comparatively long period of time. In this example, the control member 17 does not have to be provided with detailed information about the dimensions and geometry of the surface to be cleaned, so that the control member 17 is comparatively straightforward and the robot can be operated in a comparatively simple manner because the user does not have to input this information. However, the invention also comprises other embodiments, such as an embodiment where the control member 17 controls the wheel system 13 in such a manner that the wheel system 13 generates displacements of the housing 1 in accordance with a predetermined series of displacement lines. In such an alternative embodiment, the time it takes for the robot to reach all parts of the surface 9 is comparatively short, but the control member 17 is comparatively complex as it must contain detailed information about the dimensions and geometry of the surface to be cleaned, and also the operation of the robot is comparatively complex as the user must input this information. As the electrical parts of the robot are fed by said batteries or accumulators 11, the automatic displacements of the robot over the surface are not hampered or limited by a necessary electrical cord connection.

The batteries or accumulators 11 used in the robot in accordance with the invention are of a type that is known per se and customarily used in robots for vacuum cleaning surfaces. Such batteries or accumulators 11 generally have an energy capacity that is sufficient to allow the robot to treat all parts of a surface 9 of customary dimensions without being recharged. The power, i.e. the amount of energy that can be supplied by such batteries or accumulators 11 per unit of time, however, is generally limited. As a result, the suction unit 3 of the robot has only a limited suction power. In order to make sure that the suction force of the suction nozzle 7 is sufficient in spite of said limited suction power, i.e. to make sure that both the underpressure and the air flow in the suction nozzle 7 are sufficient, said suction nozzle 7 of the robot has limited dimensions. In FIG. 2, the geometry and dimensions of the suction nozzle 7 are diagrammatically represented with respect to the base circle 23. In the example shown, the suction nozzle 7 is elongated, said suction nozzle 7 extending in accordance with a radial of the base circle 23, and, as shown in FIG. 2, a width $W_S$ of the suction nozzle 7, measured along said radial, being much smaller than the diameter of the base circle 23.

To preclude that the limited width $W_S$ of the suction nozzle 7 leads to a limited suction range of the robot, i.e. a limited width of the path treated by the robot when the robot is displaced along an imaginary line of displacement, and hence to a comparatively large number of necessary displacements of the robot to treat the entire surface 9, the following measures are taken in accordance with the invention. According to the invention, the control member 17 controls the motors 25, 25', 25" of the wheel system 13 in such a manner that, in operation, said wheel system 13 generates a substantially cycloid movement of the housing 1, which is obtained by rolling an imaginary rolling circle over the surface 9 along the desired imaginary displacement line of the housing 1, which rolling circle extends parallel to the surface 9 to be cleaned and is fixed with respect to the housing 1, said suction nozzle 7 being eccentrically arranged with respect to the rolling circle. The imaginary rolling circle is indicated in FIG. 2 by means of reference numeral 37, and the line of displacement is indicated, in FIG. 2, by means of reference numeral 39. As a result of said cycloid movement, the housing 1 is displaced over the surface 9 in a direction parallel to the line of displacement 39 and, at the same time, also rotated about an axis of rotation 41 which extends perpendicularly to the surface 9 and through the center of the rolling circle 37. In the example shown, the rolling circle 37 is concentric with the base circle 23, so that the axis of rotation 41 coincides with the central main axis 2 of the housing 1. FIG. 4 diagrammatically shows nine successive positions $P_0$–$P_8$ of the suction nozzle 7 during one complete revolution of the housing 1 during said cycloid movement. FIG. 4 also shows the positions $P'_0$–$P'_8$ of the base circle 23 corresponding to said positions $P_0$–$P_8$, and the positions $P''_8$–$P''_8$ of the rolling circle 37 corresponding to said positions $P_0$–$P_8$. As the suction nozzle 7 is eccentrically arranged with respect to the rolling circle 37, the suction nozzle 7 describes a cycloid 43 over the surface 9, which cycloid is situated on both sides of the line of displacement 39. As a result, viewed at right angles to the line of displacement 39, the suction nozzle 7 reaches a path that is considerably wider than the width $W_S$ of the suction nozzle 7. As a result thereof, the suction range of the robot, i.e. the width of the path treated by the robot during the displacement of the robot in a direction parallel to the line of displacement 39, is comparatively large. The radius $R_A$ of the rolling circle 37 determines the distance covered by the robot, viewed in a direction parallel to the line of displacement 39, during one complete revolution of the housing 1. Said distance is $2\pi*R_A$ and, in the example shown wherein the suction nozzle 7 extends in accordance with a radial of the base circle 23 and has a width $W_S$ measured along this radial, is smaller than the width $W_S$. As said distance is smaller than the width $W_S$, the parts of the path treated by the suction nozzle 7 during a number of successive revolutions of the housing 1 merge without interspace, viewed in the direction of the line of displacement 39, so that the suction nozzle 7 does not leave any parts of the path untreated. In the example shown in FIG. 4, $R_A$ is approximately $0.14*W_S$, so that an overlap d of approximately $0.12*W_S$ is present between said parts of the path.

As shown in FIG. 2 and FIG. 4, the width $W_S$ of the suction nozzle 7, in the example shown, is substantially equal to the radius $R_B$ of the base circle 23, so that the radius $R_A$ of the rolling circle 37 is approximately $0.14*R_B$ in the example shown. It has been found that such a value of the ratio between the width $W_S$ and the radius $R_B$ is approximately a maximum value at which still a sufficiently large suction force of the suction nozzle 7 is achieved, i.e. a sufficient underpressure in the suction nozzle 7, when use is made of customary batteries or accumulators, such as the batteries or accumulators 11. The permissible value of the width $W_S$ is related to the value of the radius $R_B$ because an increase in the value of the radius $R_B$ also leads to an increase of the dimensions of the housing 1. As a result, in general, also the space available in the housing 1 for the batteries or accumulators increases, as a result of which the available power of the batteries or accumulators increases and hence also the suction force of the unit 3. As is further shown in FIG. 2 and FIG. 4, the suction nozzle 7 extends, in the example shown, substantially up to the base circle 23, i.e. substantially as far as the circumference of the circularly cylindrical housing 1. In this manner, the width of the path treated by the suction nozzle 7 when the housing 1 is moved in a direction parallel to the line of displacement 39 is maximized. As, in the example shown, the suction nozzle 7 extends substantially up to the circumference of the housing 1, the width of said path substantially corresponds to the diameter of the housing 1. By virtue thereof, the diameter of the housing 1 provides the user of the robot with a clear indication of the width of said path.

To generate a true cycloid movement of the housing 1 at an angular velocity $\omega_C$ of the housing 1 about the axis of rotation 41 and with a rolling circle of radius $R_A$, the control member 17 must control the motors 25, 25', 25" in such a manner that the angular velocities $\omega_1$, $\omega_2$, $\omega_3$ of the three wheels 15, 15', 15" of the wheel system 13 are in accordance with the following harmonic functions of the time t:

$$\omega_1=(R_B/R_W)*\omega_C*(1-(R_A/R_B)*\cos(\omega_C*t+\beta);$$

$$\omega_2=(R_B/R_W)*\omega_C*(1-(R_A/R_B)*\cos(\omega_C*t+\beta+2*\pi/3);$$

$$\omega_3=(R_B/R_W)*\omega_C*(1-(R_A/R_B)*\cos(\omega_C*t+\beta+4*\pi/3);$$

where $R_W$ is the radius of the wheels 15, 15', 15", and $\omega_C$ also determines the speed $V_C=\omega_C*R_A$ at which the housing 1 is displaced, during the cycloid movement, in a direction parallel to the line of displacement 39, while $\beta$ is determined by a desired direction of the line of displacement 39. As the cycloid movement thus generated is a combination of a rotation of the housing 1 and the wheel system 13 about the axis of rotation 41 and a rectilinear movement of the housing 1 and the wheel system 13 in a direction parallel to the line of displacement 39, each wheel 15, 15', 15" is momentaneously displaced, under the influence of the cycloid movement, in a direction perpendicular to its wheel axle 21, 21', 21 ", which is possible by a true rotation of the wheel 15, 15', 15" about its wheel axle 21, 21', 21 ", but also in a direction parallel to its wheel axle 21, 21', 21 ". Displacements of the wheels 15, 15', 15" in the direction parallel to their wheel axles 21, 21', 21" are possible, in the example shown, in that in any position the wheels 15, 15', 15", as described hereinabove, rest with at least one of the rolls 33 on the surface 9. In this manner, the rolls 33 lead to a greater freedom of movement of the wheels 15, 15', 15" and of the housing 1, and they enable the housing 1 to make not only a rotational movement, which would be the case in the absence of the rolls 33, but also a rectilinear movement or a combination of a rectilinear and a rotational movement, as in the case of the example shown. It is to be noted that instead of the wheels 15, 15', 15", which are provided with two basic discs 29, 31 with four comparatively large rolls 33 each, the wheel system 13 may alternatively be provided with a different type of wheel having a number of rolls along its circumference, which rolls have roll axles arranged in a tangential direction with respect to the wheel axle. An example of such a different type of wheel is a wheel provided with a single basic disc which is provided, along its circumference, with a comparatively large number of comparatively small rolls, as a result of which, in operation, in any position of the basic disc, it rests on the surface with a number of rolls. The above-described wheels 15, 15', 15" with the comparatively large rolls 33 have the advantage, however, that the rolling resistance of the wheels 15, 15', 15" in the direction of the wheel axles 21, 21', 21 " is comparatively small as a result of the relatively large diameter of the rolls 33.

It is to be noted that the displacement of the housing 1 which is controlled, in accordance with the invention, by the control member 17 comprises a substantially cycloid movement. This is to be understood to mean that the invention also includes embodiments wherein the displacement of the housing 1 that is controlled by the control member 17 is not a completely true cycloid movement. An example of such an embodiment is a movement resulting from the rolling of an imaginary rolling circle over an imaginary curved line of displacement. Another example is a movement caused by rolling an imaginary rolling circle with a constant or fluctuating slip over an imaginary line of displacement, the distance covered by the robot during one complete revolution along the line of displacement generally being unequal to $2*\pi*R_A$. Yet another example is a movement caused by rolling an imaginary rolling circle at a fluctuating angular velocity $\omega_C$ over an imaginary line of displacement. A final example relates to a movement caused by a combination of two or more of the examples mentioned hereinabove.

It is finally noted that the invention also includes embodiments of a robot which is provided with a different type of motor-driven wheel system, which enables a substantially cycloid movement of the housing to be generated. An example of such a different type of motor-driven wheel system is a wheel system provided with a number of motor-drivable wheels at least one of which is pivotable by means of a motor about a pivot axis extending perpendicularly to the surface. It is to be noted, however, that the wheel system 13 described hereinabove is particularly suitable for generating a cycloid movement because the necessary control of the individual wheels 15, 15', 15" in accordance with the above-described harmonic functions is particularly simple. In addition, the wheel system 13 enables the housing 1 to be displaced from a starting position in any desired direction in accordance with a straight or curved line of displacement, so that the robot with the wheel system 13 has substantial freedom of movement. The wheel system may alternatively be provided, for example, with more than three wheels arranged in accordance with an imaginary base circle, said wheels having wheel axles extending in accordance with radials of the base circle, or with at least three wheels that are arranged on different base circles.

What is claimed is:

1. A robot for vacuum cleaning surfaces, the robot comprising:

a housing, a suction unit accommodated in said housing, a suction nozzle mounted to the housing, which suction nozzle is situated, during operation, close to a surface to be vacuum cleaned, a motor-drivable wheel system by means of which the housing can be displaced over the surface to be cleaned, and an electrical control member for controlling a displacement of the housing to be generated by means of the motor-drivable wheel system, wherein the displacement controlled by the electrical control member comprises a substantially cycloid movement that is brought about by a rolling motion along a rolling circle and along a line of displacement of the housing over the surface to be cleaned, the suction nozzle being eccentrically arranged with respect to the rolling circle, which rolling circle extends parallel to the surface to be cleaned and is fixed with respect to the housing.

2. The robot as claimed in claim 1, wherein the wheel system comprises at least three wheels arranged at equally spaced intervals along a periphery of a base circle, each wheel having a wheel axle extending radially with respect to the base circle and each wheel being drivable by means of a motor, each wheel further being provided, along its circumference, with two or more rolls each having a roll axle extending in a tangential direction with respect to the wheel axle.

3. The robot as claimed in claim 2, wherein the rolling circle is concentric with the base circle, while the radius of the rolling circle is at most equal to approximately $W_S/2\pi$, where $W_S$ is a main dimension of the suction nozzle, measured along a radial of the base circle.

4. The robot as claimed in claim 3, wherein the suction nozzle extends, when viewed along said radial of the base circle, substantially to the periphery of said base circle.

5. The robot as claimed in claim 3, wherein the radius of the rolling circle is smaller than approximately $0.16.R_B$, where $R_B$ is the radius of the base circle.

* * * * *